US005145074A

United States Patent [19]

Miley

[11] Patent Number: 5,145,074

[45] Date of Patent: Sep. 8, 1992

[54] PLATE DISPLAY APPARATUS

[76] Inventor: Jerry N. Miley, 5855 Sandy Dr., St. Cloud, Minn. 56303

[21] Appl. No.: 707,898

[22] Filed: May 30, 1991

[51] Int. Cl.[5] ..... A47F 7/00

[52] U.S. Cl. ..... 211/41; 211/87

[58] Field of Search ..... 211/87, 41, 88, 74

[56] References Cited

U.S. PATENT DOCUMENTS

| | | | |
|---|---|---|---|
| 778,719 | 12/1904 | Stephenson | 211/41 X |
| 2,007,636 | 7/1935 | Brothers | 211/87 |
| 2,196,965 | 4/1940 | Bryan | 211/87 X |
| 2,730,243 | 1/1956 | Platt | 211/87 |
| 2,965,235 | 12/1960 | Daline | 211/87 X |
| 2,985,315 | 5/1961 | Parvolo | 211/87 X |
| 3,938,667 | 2/1976 | Buckland | 211/87 |

FOREIGN PATENT DOCUMENTS

| | | | |
|---|---|---|---|
| 254785 | 7/1926 | United Kingdom | 211/41 |

*Primary Examiner*—Robert W. Gibson, Jr.
*Attorney, Agent, or Firm*—Moore & Hansen

[57] ABSTRACT

The present invention provides apparatus for supporting plates, dishes and the like. In a preferred embodiment, the apparatus comprises an elongated rectangular frame from which a plurality of support members project forwardly. A pair of support members is provided for each plate to be displayed. These support members are arranged such that the plates are supported along their outer peripheries in at least two substantially parallel, generally horizontal planes and in at least two, substantially parallel, generally upright vertical planes. The support members include plate retention means disposed at the free end thereof.

20 Claims, 1 Drawing Sheet

PLATE DISPLAY APPARATUS

The present invention relates to apparatus for displaying plates and the like.

BACKGROUND OF THE PRESENT INVENTION

Owners of attractive plates and dishes, whether the plates are fine china, antiques, or more common items, often desire to display their possessions. To this end, numerous plate holders and the like have been developed and patented. Additionally, racks have been developed to hold or display cooking lids for everyday kitchen use.

For example, U.S. Pat. No. 674,868 to Lane teaches a rack for holding a plurality of lids of varying sizes in two vertically spaced apart rows. The lids are held in the rack by front and rear engagement of the lids with various portions of the rack.

U.S. Pat. No. 1,266,245 to Fuhrmann teaches a rack for supporting lids wherein the lids are individually supported in a single vertically oriented column. The rack comprises a pair of converging, upwardly extending legs from which a plurality of fingers project to provide a support for the lids. The lids are supported by the rack at approximately a forty-five degree angle.

U.S. Pat. No. 2,454,516 to Laureyns, U.S. Pat. No. 2,620,928 to Brooks and U.S. Pat. No. 2,939,586 to Dumains teach plate holders for supporting a plurality of plates in a single horizontal row in a generally upright fashion.

U.S. Pat. No. 2,835,394 to Seymour teaches a display rack having a base plate and rear support portions for supporting a plurality of plates in a somewhat circular orientation. The plate edges are received by slots disposed in the base plate.

Additionally, it has been known in the past to use a plate rack which mounts one or more plates in a one layer row along a wood frame with all the plates at substantially the same distance from the front face of the wood frame. Commonly the plates would be supported on the rack by means of forwardly extending spaced apart pegs which support the lower portion of each plate at two locations about the periphery of the round plate. The upper part of the plate is inclined rearwardly against the face or rack and, if desired, may be removably affixed to the rack by means of a Velcro ® type of fastener.

While each of the above prior art racks has some advantages for displaying plates, each also suffers from certain disadvantages. For example, with the exception of the Seymour device, any plate displayed on the patented holders would result in an obscuring of the decorative and aesthetically pleasing features of the plates either by components of the rack or by the other plates. While not simply blocking the features of the plate, the Seymour rack is configured such that optimal viewing can take place only from directly in front of the rack. Movement from one side to the other of the optimal point may result in an obscuring of one plate by the other. Finally, the recited prior art apparatus comprising the wooden rear support member and the bottom supporting peg members is designed primarily to accommodate a single plate size and not a plurality of plate sizes such as are commonly found in a dishware set.

It would be desirable therefore to have a plate rack capable of displaying in an aesthetically pleasing manner different sizes of plates as are commonly found in a typical dinnerware setting.

SUMMARY OF THE PRESENT INVENTION

The present invention provides a display apparatus for displaying a plurality of dishes and the like in a vertically oriented but horizontally spaced array and comprises a rectangularly configured rear support frame from which a plurality of pairs of substantially horizontally extending dish supporting legs project. Each pair of legs supports a single dish along the outer periphery thereof. Selected pairs of legs extend outwardly from the rear support frame in at least two distinct, substantially horizontal planes so that the plates are displayed in a vertical orientation in at least two spaced apart rows. Each supporting leg includes a knob or stop to engage the outer periphery of a dish. The stop on the legs comprising each pair of the legs are spaced the same distance from the support frame. The stops of at least one pair of legs are spaced a greater or lesser distance from the rear support frame than the remaining stops such that the bottom periphery of the displayed dishware are supported at at least two different distances from the support frame. In other words, the present apparatus displays plates in at least two distinct planes to provide a unique and aesthetically pleasing display.

In a representative embodiment for displaying three dishes, the present invention includes first and second pairs of pegs projecting from the support frame in a common substantially horizontal plane, each peg of the pairs having a knob attached to the free end thereof at substantially the same distance from the rear support frame. First and second, preferably similarly sized, dishes are supported along their respective outer peripheries at two locations by each of the first and second peg pairs respectively, and are retained thereon by the knobs. The knobs define plate retention means arranged so that the outer peripheries of the first and second dishes are supported at substantially the same distance from the support frame, the dishes resting at an inclined angle on the rear support frame on their respective feet at two laterally spaced points. A third pair of support pegs, which have a greater length than the first and second pair of pegs and are disposed between the first and second pairs, projects forwardly from the support member in a different plane from the common plane of the first and second pairs of legs. Each peg of the third pair also includes a knob or stop to engage and retain a dish. A third, upper support peg, is associated with the third pair and projects forwardly from the support frame substantially midway between the pegs forming the third pair but spaced upwardly therefrom. The third peg engages and supports the back side of a third plate or other dish supported by the third pair of legs and is of a length such that the third plate is supported at substantially the same viewing angle as the first and second plates, but in a plane forwardly spaced from the plane formed by the first and second plates.

The foregoing invention and the objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE PREFERRED EMBODIMENT

Figure 3:
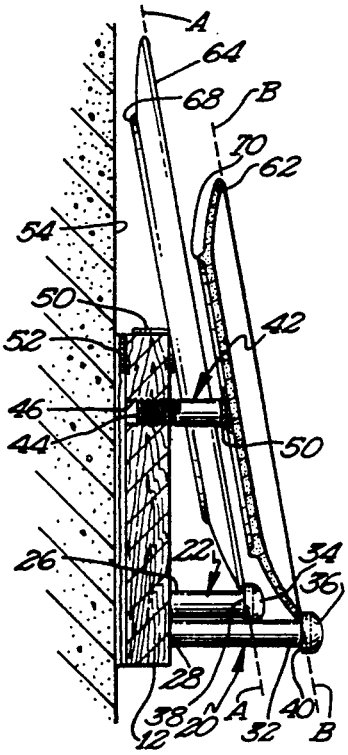
FIG. 3 is a cross sectional side elevation view of the dish display apparatus illustrated in FIG. 2 taken along cutting plane 3—3 thereof
Figure 2:
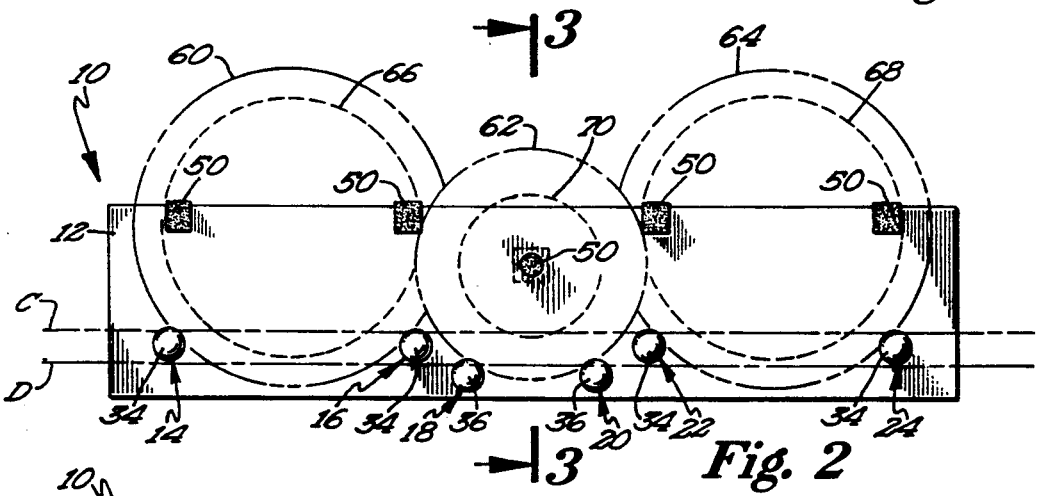
FIG. 2 is a front elevation view of the dish display apparatus illustrated in FIG. 1 showing in phantom a plurality of plates mounted thereon.
Figure 4:
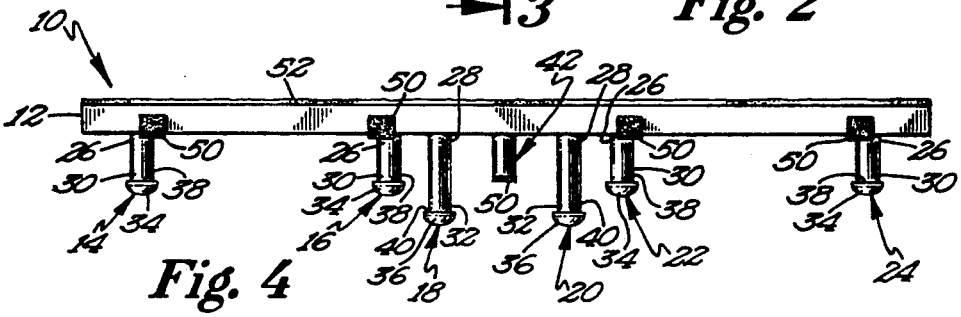
FIG. 4 is a top plan view of the dish display apparatus illustrated in FIG. 1.

FIGS. 1–4 illustrate a preferred embodiment of a dish display apparatus 10 in accordance with the present invention. Apparatus 10 comprises a rear support frame 12, here shown as having an elongated, rectangular configuration. Projecting laterally forwardly from rear frame member 12 are a plurality of plate bottom support members 14–24 that underlie and support a plurality of plates as described hereafter. Each plate support member has a first end which is attached to rear support member 12 and a second end that serves to engage the outer peripheries of the plates to be supported. Thus, using plate support members 14 and 18 as examples, each member has a first end 26 and 28 respectively which is attached to rear support member 12 and a second end 30 and 32 respectively. Second ends 30 and 32 each include a plate retention means 34 and 36 respectively. As shown in the figures, plate retention means 34 and 36 may include a knob attached to second ends 30 and 32 that engage the bottom of the plates as best shown in FIGS. 2 and 3. While the exact configuration of means 34 and 36 is not critically, they should be aesthetically pleasing and present an inner surface 38 and 40 respectively, that engages the rim of the plate it is supporting. Means 34 and 36 may be integral with members 14 and 18, respectively. Support members 14, 16, 22 and 24 are of substantially equal lengths, while support members 18 and 20 are of a substantially equal but longer length than the other support members in the embodiment shown here.

Display apparatus 10 further includes an upwardly disposed stop member. Stop member 42 has a first end 44 that is snugly received within a receptacle 46 carried by rear support member 12. Stop member 42 is spaced upwardly from members 18 and 20 and disposed substantially midway between support members 18 and 20 as best seen in FIG. 3. As best seen in FIG. 2, first end 44 and receptacle 46 may each be threaded for a threaded engagement therebetween. By making the engagement between stop member 42 and receptacle 46 a threaded engagement, stop member 42 may be turned into and out of receptacle 46 thus providing means for adjusting the relative distance of the second end 48 of stop member 42 from the surface of rear support member 12. Stop member 42 and rear support member 12 may include cushioning means 50 respectively disposed thereon where a plate would come in contact therewith. Cushioning means 50 may be a Velcro® type of material to removably affix a plate thereto. If desired, rear support member 12 may include a hook and loop type of attachment 52, which may also be a Velcro® type of material, on the rear side thereof for positioning display apparatus 10 on a wall such as wall 54 as shown in FIG. 2.

In operation, display apparatus 10 will support a plurality of different sized plates, such as plate 60, 62 and 64 as shown in FIG. 2. As seen in FIGS. 2 and 3, supports 18 and 20 are disposed relatively lower than supports 14, 16, 22, and 24 such that plate 62 is supported at its lower edge thereof at a relatively lower level than are plates 60 and 64. As best seen in FIGS. 2 and 3, plate 62 is supported on its outer periphery at a point upwardly from its lower supports by stop member 42. As best seen in FIG. 3, plates 60 and 64 are supported such that their rims lie in a common generally upright plane A. The rim of plate 62 lies in a generally upright plane B, which is substantially parallel to plane A for aesthetic reasons. Additionally, referring to FIG. 2, plates 60 and 64 are supported by members 14 and 16, and 22 and 24, respectively, such that the points of plate support, i.e., the engagement of the plates with the support members, lie in a substantially horizontally oriented plane C. Similarly, plate 62 is supported by members 18 and 20 such that the points of plate support therefore lie in a substantially horizontally oriented plane D which is separate and distinct from plane C.

The adjustable nature of stop member 42 is preferred because it engages plate 62 at a location differently from that where rear support member 12 engages plates 60 and 64. That is, foot 66 and foot 68 of plates 60 and 64, respectively, engage rear support member 12 at two locations, each which may be cushioned or may be covered by one half of a Velcro® type of hooks and loops fastener, as noted previously. Foot 70 of plate 62 is not engaged by stop member 42; rather stop member 42 engages the back of plate 62 in the area defined by foot 70. Since the height of plate feet vary, and since some plates do not have a foot, stop member 42 must be adjustable to accommodate the variety of plate backsides that may be encountered. Due to the differing configurations of plates on the rear side thereof, then, the adjustable nature of stop member 42 enables the relative viewing angle of plate 62 to be adjusted such that, as best seen in FIG. 3 the rims of plates 62 and 64 form substantially parallel planes. In other words, plates 62 and 64 are all supported such that they are at the same viewing angle.

Figure 1:
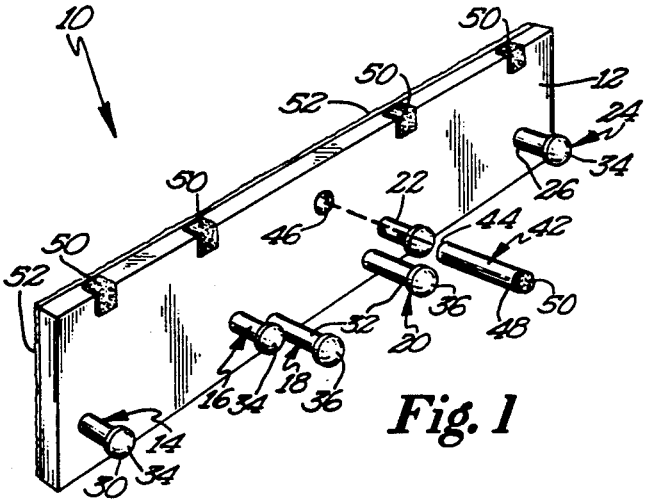
FIG. 1 is a perspective view of a dish display apparatus embodying the present invention.
Figure 5:
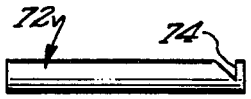
FIG. 5 shows in a side elevation view an alternative plate retention means.

FIG. 5 shows an alternative bottom support member 72. Member 72 includes a notch 74 at its end thereof for receiving the edge of a plate. Thus notch 74 functions as a plate retention means.

The present invention thus provides apparatus for supporting dishware in two generally upright oriented and two generally horizontally oriented planes, but at the same viewing angle. That is, the two upright oriented planes are generally parallel to each other as are the two horizontally oriented planes.

Having thus described the present invention, other modifications, alterations, or substitutions may now suggest themselves to those skilled in the art, all of which are within the spirit and scope of the present invention. It is therefore intended that the present invention be limited only by the scope of the attached claims below.

I claim:

1. Apparatus for displaying a plurality of plates and the like, each plate having an outer periphery, said apparatus comprising:

a generally upright support frame;

a plurality of pairs of support members, each of said support members extending outwardly from said support frame, a first pair of said support members underlying and supporting a first plate along the outer periphery of the plate in an upright plane orientation, said upright support frame engaging the first plate at a position spaced upwardly from said first pair of support members, and a second pair of said support members underlying and supporting a second plate along the outer periphery of the second plate, said second pair of support members supporting the second plate outer periphery such that the second plate outer periphery is spaced forwardly from said support frame a greater distance than is the first plate outer periphery; and a spacer member fixed to and extending outwardly from said support frame to engage the second plate above said second pair of support members to position the second plate forwardly of the first plate.

2. The apparatus of claim 1 wherein the first plate is supported such that the outer periphery of the first plate defines a first viewing plane and wherein the second plate is supported such that the outer periphery of the second plate defines a second viewing plane, said first and second planes being generally parallel to each other and spaced apart, said first plane being positioned closer to said frame than said second plane.

3. The apparatus of claim 1 wherein said second pair of support members is positioned below said first pair such that the second plate is supported at a level lower than the first plate.

4. The apparatus of claim 1 wherein at least one of said support members includes means for retaining the plate on said support member.

5. The apparatus of claim 4 wherein said means for retaining comprises a notch formed in said support member, said notch configured to receive the outer periphery of a plate.

6. The apparatus of claim 1 wherein at least one of said support members comprises an elongate peg and a knob at the end thereof, said knob having an inner bearing surface engaging the outer periphery of the plate.

7. The apparatus of claim 1 wherein said apparatus includes a third pair of support members for supporting a third plate and said second pair of support members are disposed between said first and third pairs.

8. The apparatus of claim 1 wherein said spacer member includes means for adjusting the length of said spacer member.

9. The apparatus of claim 1 wherein at least one of said support members comprises an elongate peg, said peg including a notch formed in said peg support member, said notch configured to receive the outer periphery of a plate.

10. The apparatus of claim 7 wherein the first and third plates are supported such that the outer periphery of the first and third plates define a first viewing plane and wherein the second plate is supported such that the outer periphery of the second plate defines a second viewing plane, said first and second planes being generally parallel to each other and spaced apart, said first plane being positioned closer to said frame than said second plane.

11. Apparatus for displaying a plurality of plates and the like, each plate having an outer periphery, said apparatus comprising:

a generally upright support frame;

a plurality of pairs of support members, each said support member engaged with and extending outwardly from said support frame, a first pair of said support members underlying and supporting a first plate along the outer periphery of the plate in an upright plane orientation, said upright support frame engaging the first plate at a position spaced upwardly from said first pair of support members, and a second pair of said support members underlying and supporting a second plate along the outer periphery of the second plate, said second pair of support members supporting the second plate outer periphery such that the second plate outer periphery is spaced forwardly from said support frame a greater distance than is the first plate outer periphery, wherein at least one of said support members comprises an elongate peg having a means for retaining a plate at the free end thereof; and a spacer member fixed to and extending outwardly from said support frame to engage the second plate above said second pair of support members to position the second plate forwardly of the first plate.

12. The apparatus of claim 11 wherein the first plate is supported such that the outer periphery of the first plate defines a first viewing plane and wherein the second plate is supported such that the outer periphery of the second plate defines a second viewing plane, said first and second planes being generally parallel to each other and spaced apart, said first plane being positioned closer to said frame than said second plane.

13. The apparatus of claim 11 wherein said second pair of support members is positioned below said first pair such that the second plate is supported at a level lower than the first plate.

14. The apparatus of claim 11 wherein said apparatus includes a third pair of support members for supporting a third plate and said second pair of support members are disposed between said first and third pairs.

15. The apparatus of claim 14 wherein the first and third plates are supported such that the outer periphery of the first and third plates define a first viewing plane and wherein the second plate is supported such that the outer periphery of the second plate defines a second viewing plane, said first and second planes being generally parallel to each other and spaced apart, said first plane being positioned closer to said frame than said second plane.

16. The apparatus of claim 11 wherein said spacer member includes means for adjusting the length of said spacer member.

17. The apparatus of claim 11 wherein said means for retaining comprises a knob having an inner bearing surface engaging the outer periphery of the plate.

18. Apparatus for displaying a plurality of plates and the like, each plate having an outer periphery, said apparatus comprising:

a generally upright support frame;

a plurality of pairs of support members, each said support member engaged with and extending outwardly from said support frame, a first pair of said support members underlying and supporting a first plate along the outer periphery of the plate in an upright plane orientation, said upright support frame engaging the first plate at a position spaced upwardly from said first pair of support members, and a second pair of said support members underlying and supporting a second plate along the outer periphery of the second plate, said second pair of support members supporting the second plate outer periphery such that the second plate outer periphery is spaced forwardly from said support frame a greater distance than is the first plate outer periphery; and a spacer member fixed to and extending outwardly from said support frame to engage the second plate above said second pair of support members to position the second plate forwardly of the first plate, wherein said spacer member includes means for adjusting the length of said spacer member.

19. The apparatus of claim 18 wherein the first plate is supported such that the outer periphery of the first plate defines a first viewing plane and wherein the second plate is supported such that the outer periphery of the second plate defines a second viewing plane, said first and second planes being generally parallel to each other and spaced apart, said first plane being positioned closer to said frame than said second plane.

20. The apparatus of claim 18 wherein said second pair of support members is positioned below said first pair such that the second plate is supported at a level lower than the first plate.

* * * * *